US005833512A

United States Patent [19]

Nicola

[11] Patent Number: 5,833,512

[45] Date of Patent: Nov. 10, 1998

[54] SLOTTED AND GROOVED CONSTRUCTION TOY

[76] Inventor: Stephen Douglas Nicola, 430 9th Ave. #12, San Francisco, Calif. 94118

[21] Appl. No.: 599,981

[22] Filed: Feb. 14, 1996

[51] Int. Cl.[6] ..... A63H 33/06

[52] U.S. Cl. ..... 446/114; 446/116; 446/127

[58] Field of Search ..... 446/85, 108, 114, 446/116, 127, 106; 273/153 R, 155, 156, 160

[56] References Cited

U.S. PATENT DOCUMENTS

| | | | |
|---|---|---|---|
| 2,633,662 | 4/1953 | Nelson | 446/114 |
| 3,177,611 | 4/1965 | Beck | 446/114 |
| 3,537,706 | 11/1970 | Heavener, Jr. | 446/85 |
| 3,564,758 | 2/1971 | Willis | 446/114 |
| 3,790,175 | 2/1974 | Ragnow | 273/160 |
| 4,569,665 | 2/1986 | Belton | 446/114 |
| 4,740,188 | 4/1988 | Coster | 446/114 |
| 4,789,370 | 12/1988 | Ellefsno | 446/114 |
| 5,104,345 | 4/1992 | Lyman | 446/114 |
| 5,251,900 | 10/1993 | Gallant | 273/160 |

OTHER PUBLICATIONS

1995, Wizbits, by The Wizbits Co.

Plastic Construction Sets, Master Builder Toys Inc., "Playthings", Mar. 1948, p. 212.

*Primary Examiner*—Robert A. Hafer

*Assistant Examiner*—Jeffrey D. Carlson

[57] ABSTRACT

A slotted and grooved construction toy of the type having a plurality of flat bodies with slots interlocking with other flat bodies. The flat bodies have a plastic foam core in combination with a laminated surface. The foam core is a semi-rigid and compressible material which is resilient and durable after repeated use. The laminate is a durable and scratch resistant material that will provide a compressible surface to the foam core. The grooves provide a channel to guide and support the interlocking flat bodies of the construction toy, while allowing a firm, tight connection between the flat bodies and providing a countervailing barrier to shearing stress.

4 Claims, 7 Drawing Sheets

SLOTTED AND GROOVED CONSTRUCTION TOY

BACKGROUND OF THE INVENTION

1. Field of the Invention

This invention relates to slotted construction toys, specifically to such construction toys consisting of a plurality of flat bodies with a slot sliding across and interlocking with grooves on similar flat bodies.

2. Discussion of the Prior Art

Heretofore, interlocking slotted construction toys have commonly been manufactured with solid plastic, soft foamed plastic, or solid cardboard, and designed as a plurality of flat bodies with each body having approximately two to four slots approximately one quarter to one third of the way across the width of the body. The toy sold under the commercial name "Pickets," manufacturer unknown, is an example of the solid plastic type of slotted construction toy. The toy sold under the commercial name of "Magic Blocks," manufacturer unknown, is an example of the soft foamed plastic type of slotted construction toy. The toy sold under the commercial name of "Wizbits," sold by the Wizbits Company, is an example of the solid cardboard type of slotted construction toy. The toy sold under the commercial name of "Locktagons," made by the Lauri Company, is an example of the soft foam plastic type of slotted construction toy.

The flat bodies of these example construction toys are meant to be connected with one slot sliding into another slot. This slot-to-slot manner of connection allows for constructions which are stable only if the overall construction does not contain stresses which tend to pull the slots apart. With solid plastic, the reason for the weak connection is that the slot must be slightly wider than the flat body of the toy, and thus the slot is unable to firmly grasp the flat body of the toy. With soft foamed plastic, the slots do not have sufficient rigidity to form a tight connection with the flat body of the toy. Again, with solid cardboard, the slot cannot be narrow enough to allow for a tight connection. With all of these examples, a minimal amount of stress will easily pull the slot-to-slot connection apart, thus the constructions cannot be handled roughly or built with significant countervailing stresses, and the functionality of the toy is thus limited. Also, none of these toys are designed to connect in any way other than slot-to-slot. If a slot is connected over the flat body where there is no corresponding slot, the toy will pull apart with the slightest amount of shearing stress, rendering this type of connection almost completely non-functional.

Accordingly, it is a principal objective of the present invention to overcome the prior art problems and difficulties in forming a firm and stable connection between the flat bodies of the toy, in a slot-to-slot type of manner, and, more significantly, in a manner where the slot can firmly connect to the flat body itself, without there having to be a corresponding slot to complete the connection, and to thereby provide a simple and elegant construction toy where it is possible to create structures of exceptional soundness and functionality.

SUMMARY OF THE INVENTION

The aforesaid objective and its corollaries are accomplished by providing a slotted construction toy:

that has the durability, rigidity, and scratch resistance of a plastic foam core in combination with paper lamination, without the resistance to compressive stress and the ensuing functional limitations of materials such as solid plastic and solid cardboard;

where the actual slot connection is stable, firm and resists countervailing and shearing stress, while at the same time easily functions as a connectable and disconnectable toy;

which has a matching pattern of grooves on both sides of the flat body, providing the flat body with grooves which allow the slot to slide firmly into the grooves while compressing the paper laminate and plastic foam core and thereby forming a tight connection.

which allows for connections of slot-to-groove as well as slot-to-slot type;

which allows for slot-to-groove connections which strongly resist countervailing and shearing stresses, and which is lightweight and allows for large constructions without ensuing collapse.

Further objects and advantages of the invention will become apparent from a consideration of the ensuing description and drawings.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE ILLUSTRATED EMBODIMENTS

Figure 2:
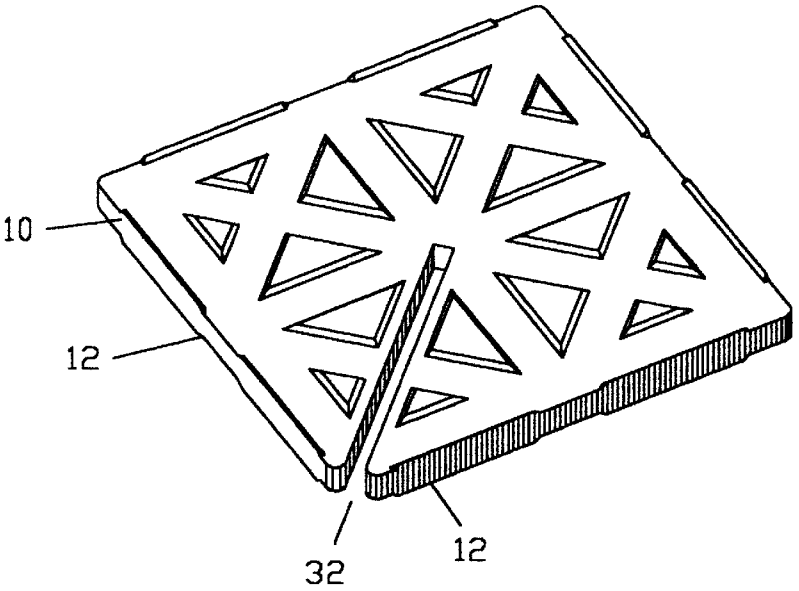
FIG. 2 is an isometric view of a typical element of the present invention with square shape and a single slot on one corner of the shape.
Figure 1:
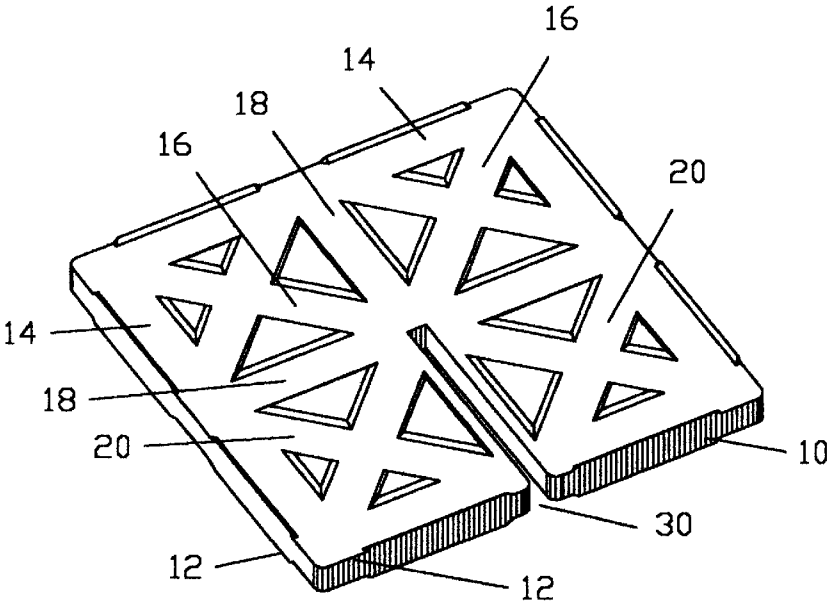
FIG. 1 is an isometric view of a typical element of the present invention with square shape and a single slot on one side of the shape.
Figure 4:
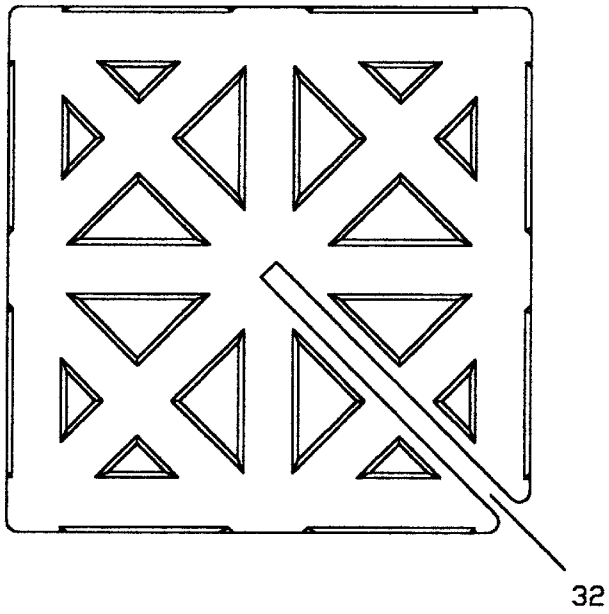
FIG. 4 is a full face view of an element of the present invention with square shape and a single slot on one corner of the shape.
Figure 3:
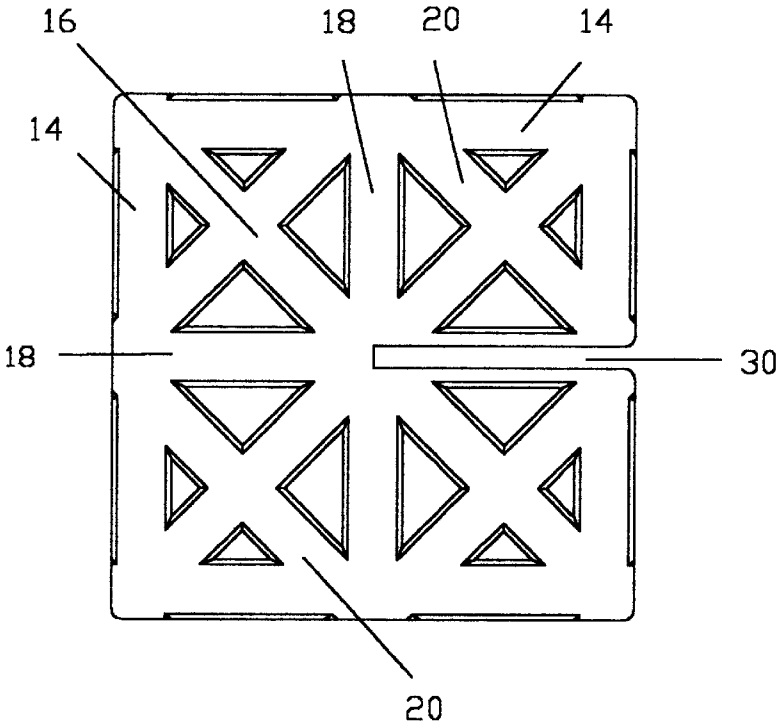
FIG. 3 is a full face view of an element of the present invention with square shape and a single slot on one side of the shape.
Figure 5:
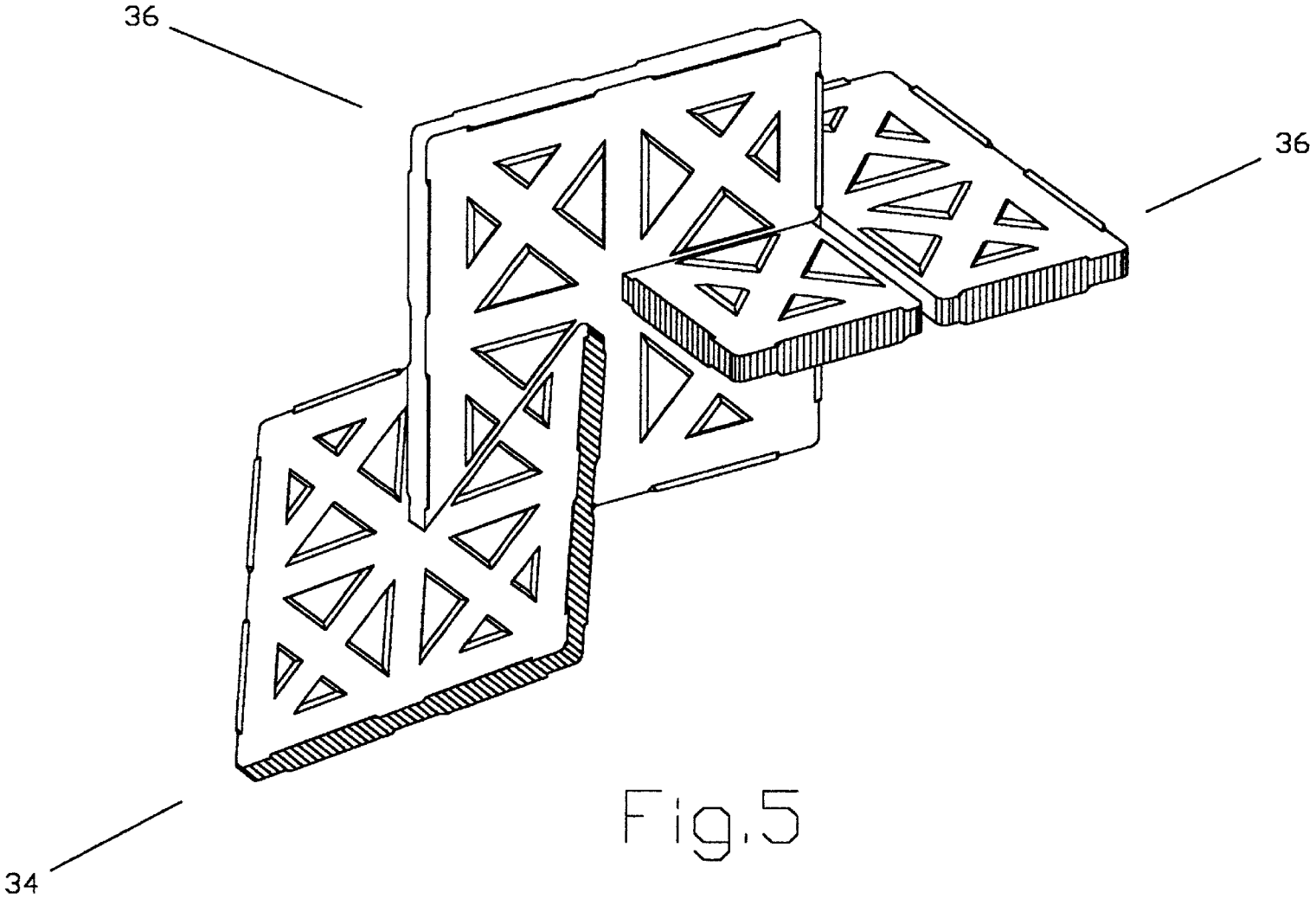
FIG. 5 is an isometric view of an element of the present invention with one corner-slotted square shape and two side-slotted square shapes connected together.
Figure 7:
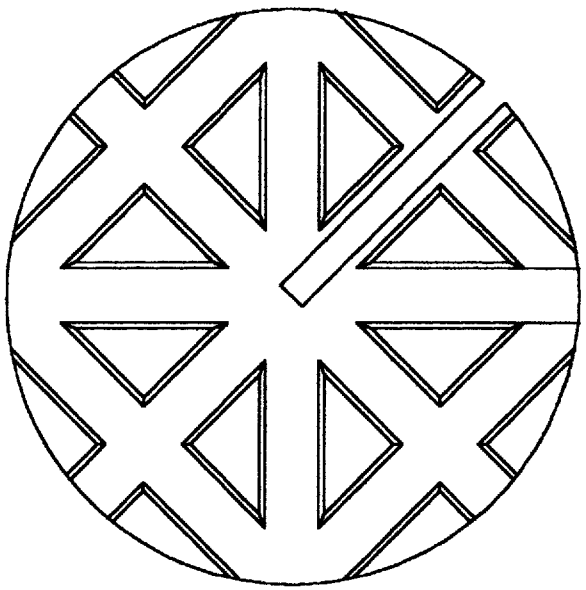
FIG. 7 is a full face view of an element of the present invention with circular shape and with a slot in a different position from that depicted in FIG. 6.
Figure 6:
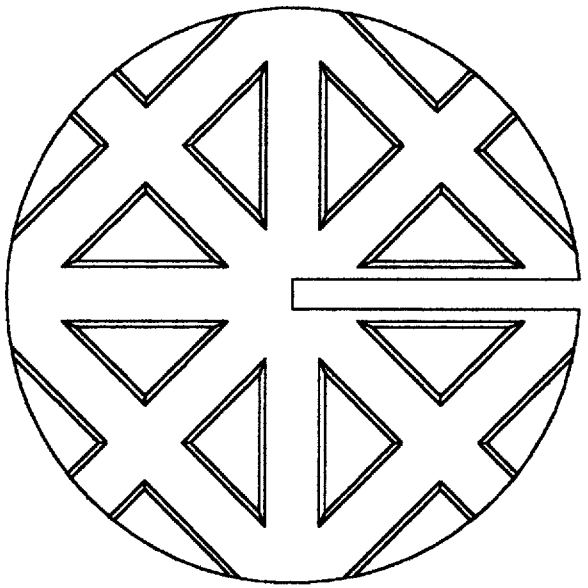
FIG. 6 is a full face view of a typical element of the present invention with circular shape and with one possible position of a slot.
Figure 9:
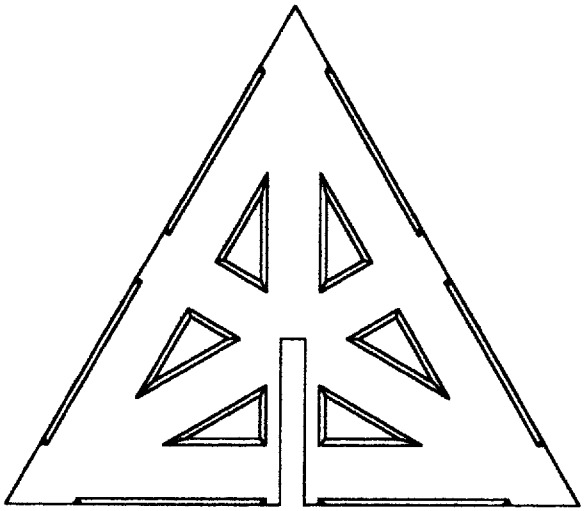
FIG. 9 is a full face view of an element of the present invention with equilateral triangular shape and with a slot in a side of the shape.
Figure 8:
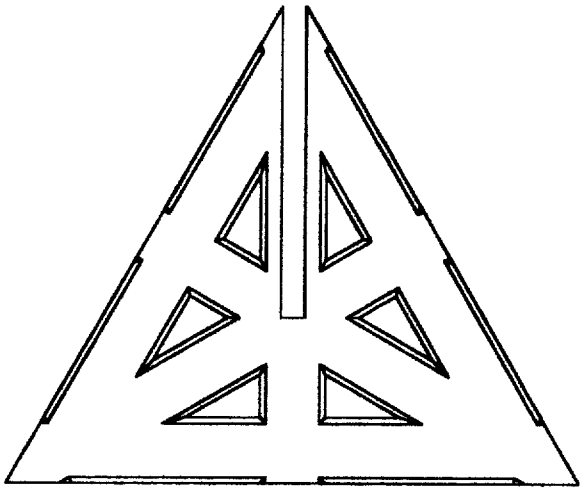
FIG. 8 is a full face view of a typical element of the present invention with equilateral triangular shape with a slot in a corner of the shape.
Figure 10:
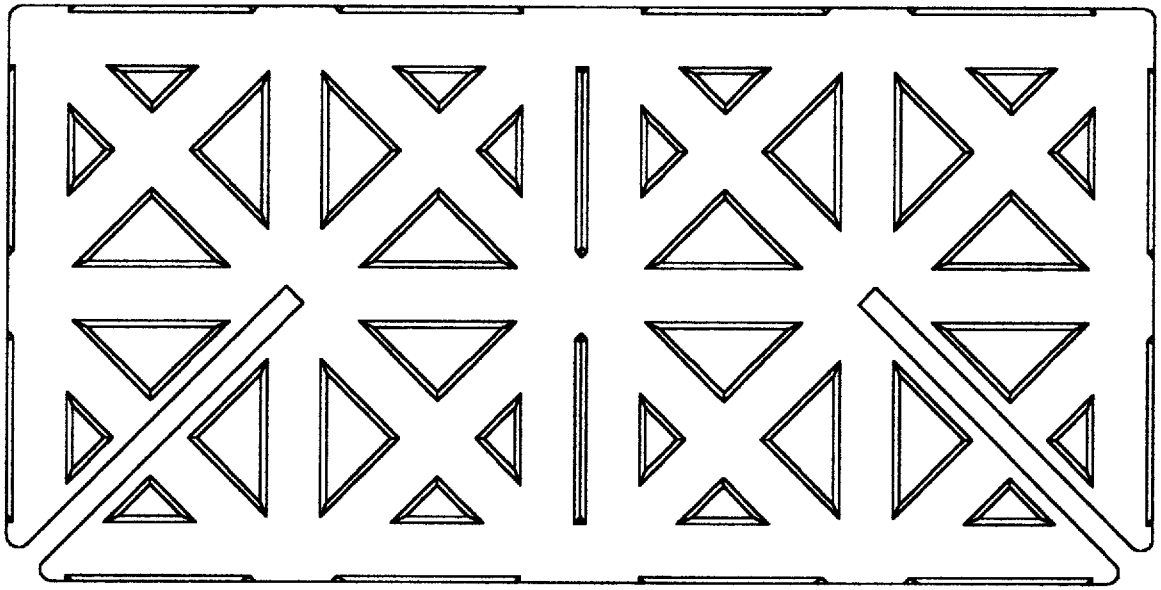
FIG. 10 is a full face view of a typical element of the present invention with rectangular shape and slots in two of the corners of the shape.
Figure 11:
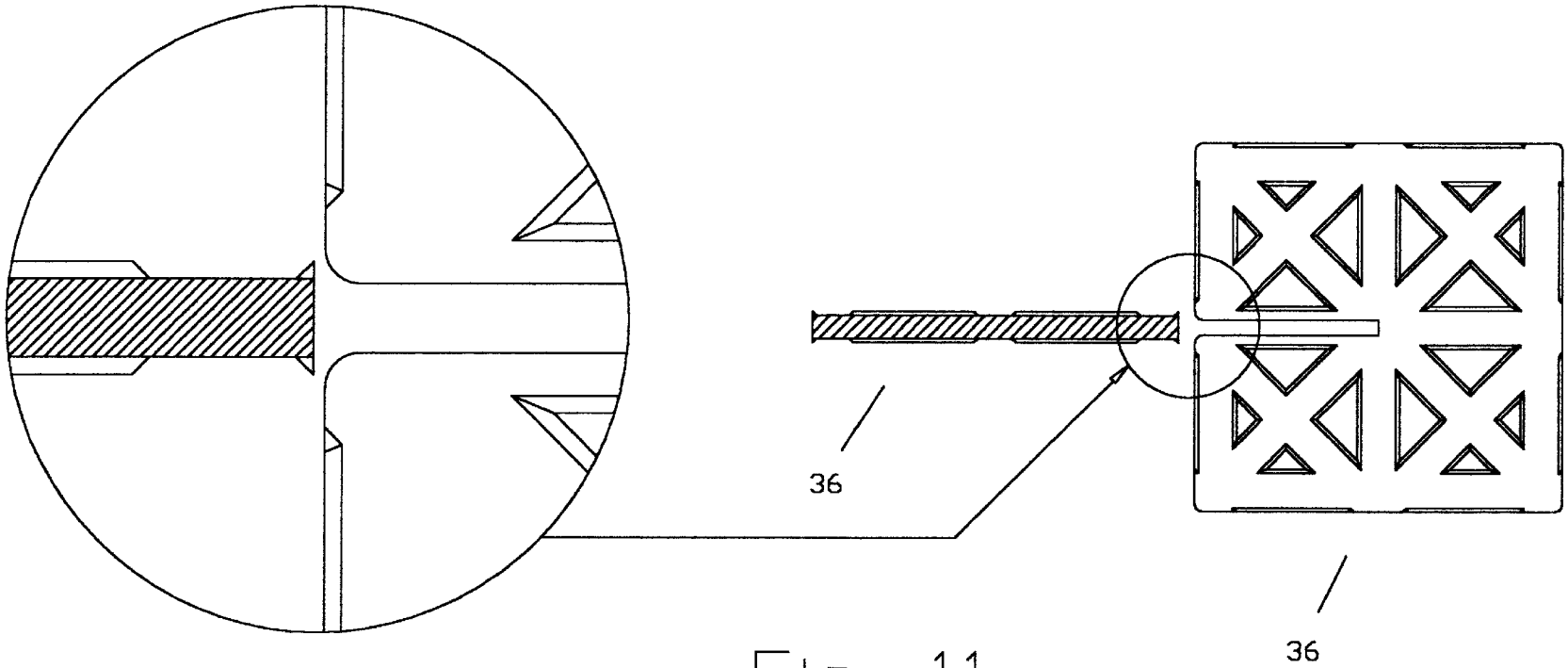
FIG. 11 is a sectional view depicting the interlocking slot and groove of the present invention, with an enlarged view depicting the width of the slot in relation to the thickness of the flat body.

Referring now to the drawings and especially FIGS. 1 to 5, there is shown a square shaped plastic foam core 10 in combination with a paper laminate 12 which covers both faces of the flat body of the plastic foam core. FIG. 1 shows an element of the invention with a single slot 30 cut into the center of one side of the flat body and continuing to the center of the flat body. FIG. 2 shows an element of the invention with a single slot 32 cut into a corner of the flat body and continuing to the center of the flat body. FIGS. 1 to 4 illustrate the manner and position of the grooves on the surfaces of the square shaped flat body. A groove 14 extends the full length down each edge of the flat body. A groove 16 extends the full length from a corner of the flat body to an opposite corner of the flat body. A groove 18 extends the full length from the center of a side of the flat body to the center of an opposite side of the flat body. A groove 20 extends the full length from the center of a side of the flat body to the center of an adjacent side of the flat body. FIG. 5 shows a corner-slotted element of the invention connected with a side-slotted element of the invention which is connected to another side-slotted element of the invention. FIGS. 6 to 10 show additional geometric shapes in other elements of the invention. FIG. 11 shows a sectional view of the invention with an enlarged view showing the width of the slot in relation to the thickness of the flat body.

In the preferred embodiment of the invention, the elements of the invention depicted in FIGS. 1 to 11 all have a dense cellular foamed plastic core which is flexible to pinching or compressive stress and will retain its resilience when repeatedly pressed and released in a pinching type of manner. Laminated onto this foam core is a durable paper material similar to material used for the cover of a soft-cover book. The laminated paper surface and dense foam core provide an article which is flexible and resilient under compressive stress, while being stiff and resistant to bending and shearing stresses and while also remaining lightweight. The grooves of the flat body are formed by being molded directly into the plastic foam core, with the paper surface being laminated onto the foam core and fully conforming with the indented grooves of the foam core.

Other methods for manufacturing this article have been envisioned. This article can be made with any materials that will retain the above basic characteristics, such as a thin, semi-rigid plastic surface laminated onto a dense foam interior; two plastic surfaces combined in a way to form a compressible article with a hollow interior; possible solid plastics that have compressive and resilient features, or other combinations of plasticized materials, cardboards, woods, papers, etc. The indented grooves can be formed in other ways, such as combining a smooth foam core with grooves molded into the material of the paper laminate, or by any other manner which will form the desired grooves and maintain the functionality of the construction toy.

The paper laminated foam core article is designed in such a way that the thickness of the grooved areas on the flat body is slightly wider than the slot. This allows the slot of one flat body to slide laterally over the surface of the groove of another flat body while compressing the laminate and foam, thus forming a firm and stable connection. When the connection is pulled apart, the foam core decompresses and the article resumes its normal shape. The slots are designed to be just wide enough to slide into the grooves but are too narrow to rise above the raised surfaces on the face of the flat body.

From the description above, a number of advantages of invention become evident:

the paper laminate surface is durable, fracture-resistant and scratch-resistant, all of which are desirable features in a construction toy:

the foam core and laminate combination is compressible and resilient, allowing for a firm, stable, stress-resistant connection;

the dense foam and moderately flexible laminate tend to keep their shape over repeated compression and release, allowing for a connection that remains strong after repeated use;

the use of plastic foam core, a lightweight material, decreases the overall weight of large constructions, reducing gravitational stresses;

the indented grooves prevent sideways slippage, allowing for increased structural stability when under shearing and countervailing stresses;

the indented grooves guide the direction of the interconnecting pieces, facilitating precise construction design;

the regular geometric pattern of grooves enhances the overall aesthetic quality of construction designs.

Accordingly, it is evident from the above description that the laminated foam core of this slotted construction toy, combined with reinforcing grooves, will allow for a firm, strong interconnection between the pieces of the toy. The constructions can be picked up and manipulated in a variety of ways, handled roughly, turned upside down and sideways, held by a single piece or hung from the ceiling with string. Furthermore, the laminated foam core has additional advantages in that:

it provides a surface which is durable and cleanable;

it allows for large constructions without slippage and collapse;

it provides for a slot connection which is easily connected and durable under repeated use;

it provides built in geometric patterns which enhance overall aesthetic appeal.

Although the description contains many specifications, these should not be construed as limiting the scope of the invention but as merely providing illustrations of some of the presently preferred embodiments of this invention. For example, the pieces could have a variety of shapes such as trapezoidal, hexagonal, oval, etc.; the grooves could be patterned in other ways, or there could be more grooves or fewer grooves; the slots could be lengthened, shortened, increased in number or, on some pieces, eliminated entirely; the constructions can be used in other ways, i.e. as pure sculpture, as architectural modeling aids, as an educational device, as a puzzle, as shelves and racks, as coasters, as a doll house, as jewelry racks, etc.

Thus, the scope of the invention should be determined by the appended claims and their legal equivalents, rather than by the examples given

I claim:

1. A construction toy comprising a plurality of flat bodies of regular polygonal shape, said flat bodies having a single slot sized to frictionally receive similarly formed bodies, said slot receiving said flat bodies at various positions where there is no corresponding slot on said flat bodies, and said slot substantially extending from the center of one side of said flat bodies to the center of said flat bodies, each of said flat bodies having relatively thinner portions and relatively thicker portions, said thinner portions being sized to allow said slot to frictionally slide across said thinner portions, said thicker portions being sized to prevent said slot from sliding across said thicker portions, said thicker portions being formed such that said slot is prevented from sliding sideways by said thicker portions when said slot is connected with said flat bodies, said thinner portions and said thicker portions thus acting together to form grooves with embankments where the bottom of said grooves is formed by said thinner portions and the embankments of said grooves are formed by said thicker portions, said grooves allowing said slot to frictionally slide forwards or backwards smoothly and unobstructed into or out of said grooves, said slot being connected to said flat bodies by frictionally sliding said slot into said grooves at a point where there is no corresponding slot on said flat bodies, said grooves and said frictional sliding acting together to allow secure connections without sideways motion of said slot, said grooves allowing said connections to be formed beginning at various restricted positions around the perimeter of said flat bodies and continuing down the length of said grooves until said flat bodies have been completely inserted into said slot, said grooves at various points on their length being intersected by other grooves proceeding in different directions, said various restricted positions providing numerous places for securely connecting said slot to similarly formed bodies without the necessity of a slot on the corresponding body to assist the connection; whereby, through the use of such structurally supporting grooves, resulting constructions have a high degree of stability and a high degree of resistance to shearing, torquing and gravitational stresses, and also, through the use of such grooves formed on said flat body and functioning independently of the slot on the same flat body, the resulting constructions have a high degree of functional modularity and numerous possible ways of connecting the flat bodies to each other by the insertion of the slot into any of the numerous places offered by the grooves.

2. The construction toy of claim 1 wherein said flat bodies are of substantially square shape and said grooves substantially:

extend along each edge of said flat bodies from each corner to each adjacent corner;

extend from each corner of said flat bodies to each diagonally opposite corner of said flat bodies;

extend from the center of each side of said flat bodies to the center of each opposite side of said flat bodies, and extend from the center of each side of said flat bodies to the center of each adjacent side of said flat bodies.

3. A construction toy comprising a plurality of flat bodies of regular polygonal shape, said flat bodies having a single slot sized to frictionally receive similarly formed bodies, said slot receiving said flat bodies at various positions where there is no corresponding slot on said flat bodies, and said slot substantially extending from one corner of said flat bodies to substantially the center of said flat bodies, each of said flat bodies having relatively thinner portions and relatively thicker portions, said thinner portions being sized to allow said slot to frictionally slide across said thinner portions, said thicker portions being sized to prevent said slot from sliding across said thicker portions, said thicker portions being formed such that said slot is prevented from sliding sideways by said thicker portions when said slot is connected with said flat bodies, said thinner portions and said thicker portions thus acting together to form grooves with embankments where the bottom of said grooves is formed by said thinner portions and the embankments of said grooves are formed by said thicker portions, said grooves allowing said slot to frictionally slide forwards or backwards smoothly and unobstructed into or out of said grooves, said slot being connected to said flat bodies by frictionally sliding said slot into said grooves at a point where there is no corresponding slot on said flat bodies, said grooves and said frictional sliding acting together to allow secure connections without sideways motion of said slot, said grooves allowing said connections to be formed beginning at various restricted positions around the perimeter of said flat bodies and continuing down the length of said grooves until said flat bodies have been completely inserted into said slot, said grooves at various points on their length being intersected by other grooves proceeding in different directions, said various restricted positions providing numerous places for securely connecting said slot to similarly formed bodies without the necessity of a slot on the corresponding body to assist the connection; whereby, through the use of such structurally supporting grooves, resulting constructions have a high degree of stability and a high degree of resistance to shearing, torquing and gravitational stresses, and also, through the use of such grooves formed on said flat body and functioning independently of the slot on the same flat body, the resulting constructions have a high degree of functional modularity and numerous possible ways of connecting the flat bodies to each other by the insertion of the slot into any of the numerous places offered by the grooves.

4. The construction toy of claim 3 wherein said flat bodies are of substantially square shape and said grooves substantially:

extend along each edge of said flat bodies from each corner to each adjacent corner;

extend from each corner of said flat bodies to each diagonally opposite corner of said flat bodies;

extend from the center of each side of said flat bodies to the center of each opposite side of said flat bodies, and extend from the center of each side of said flat bodies to the center of each adjacent side of said flat bodies.

* * * * *